US007331080B2

(12) United States Patent
Chen

(10) Patent No.: US 7,331,080 B2
(45) Date of Patent: Feb. 19, 2008

(54) BATHING BRUSH

(76) Inventor: Ching-Chen Chen, No. 80-2, Wung-Yuann Rd., Pei-Dou County, Chang-Hau Hsien (TW)

( * ) Notice: Subject to any disclaimer, the term of this patent is extended or adjusted under 35 U.S.C. 154(b) by 609 days.

(21) Appl. No.: 10/390,634

(22) Filed: Mar. 19, 2003

(65) Prior Publication Data

US 2004/0181892 A1 Sep. 23, 2004

(51) Int. Cl.
*A47K 7/02* (2006.01)

(52) U.S. Cl. ..... 15/110; 15/147.2; 15/229.13; 15/209.1

(58) Field of Classification Search ..... 15/209.1, 15/210.1, 110, 137, 223–226, 229.11, 229.13, 15/145, 147.1, 147.2; 601/134–138
See application file for complete search history.

(56) References Cited

U.S. PATENT DOCUMENTS 5,592,713 A * 1/1997 Rones ..... 15/210.1
5,758,386 A 6/1998 Chen
5,944,032 A 8/1999 Masterson
6,041,466 A * 3/2000 Payton, Jr. ..... 15/105
6,092,258 A 7/2000 Chen
6,195,829 B1 * 3/2001 Chen ..... 15/110
6,601,259 B2 * 8/2003 Chang ..... 15/209.1

* cited by examiner

*Primary Examiner*—John Kim
*Assistant Examiner*—Shay Balsis
(74) *Attorney, Agent, or Firm*—Lowe Hauptman Ham & Berner, LLP

(57) ABSTRACT

A bathing handle, which detachably fastens a bathing ball with a fastening device thereon to be a bathing brush, comprises a bearing portion having a predetermined length, width and height, a connection portion provided on the bearing portion to fasten the bathing ball on the bearing portion and restrict the bathing ball from moving along a height orientation of the bearing portion, and a positioning portion having an annular flange on the bearing portion and a plurality of protrusions projected from a top of the flange to restrict the bathing ball from moving along a length orientation and a width orientation.

10 Claims, 7 Drawing Sheets

BATHING BRUSH

BACKGROUND OF THE INVENTION

1. Field of the Invention

The present invention relates generally to a bathing tool, and more particularly to a bathing brush which has a bathing handle to detachably attach cleaning devices thereon.

2. Description of the Related Art

In prior art, conventional bathing tools made from a flexible net-like element typically had two types, the first one of which was a bathing ball disclosed in the U.S. Pat. No. 5,944,032 and the second one of which was a bathing brush with handle disclosed in the U.S. Pat. No. 6,092,258 and U.S. Pat. No. 5,758,386.

The bathing brush was more popular to users than bathing ball, however, the bathing brush is more expensive that the bathing ball. The conventional bathing brush had a flexible net-like element fixedly fastened on a handle so that the bathing brush had to be discarded after the flexible net-like element had lost flexibility or was dirty. Some bathing brushes had the handles made from plastics that can not recycle.

Another drawback of the conventional bathing brush is that the flexible net-like element only has its central portion fastened to the handle, the net-like element always moves randomly when the brush is brushing something and that will make user can not operate the brush smoothly and make the cleaning work harder.

SUMMARY OF THE INVENTION

The primary objective of the present invention is to provide a bathing handle of a bathing brush, which replace cleaning means in an easier way.

The second objective of the present invention is to provide a bathing handle of a bathing brush, which can fixedly fasten the cleaning means on the handle.

The third objective of the present invention is to provide a bathing handle of a bathing brush, which can secure a conventional bathing ball with any shape and size on the handle in an easier way.

According to the objectives of the present invention, a bathing handle, which detachably fastens a bathing ball with a fastening device thereon to be a bathing brush, comprises a bearing portion having a predetermined length, width and height, a connection portion provided on the bearing portion to fasten the bathing ball on the bearing portion and restrict the bathing ball from moving along a height orientation of the bearing portion, and a positioning portion having a plurality of protrusions or an annular flange on the bearing portion to restrict the bathing ball from moving along a length orientation and a width orientation.

DETAILED DESCRIPTION OF THE INVENTION

Figure 1:
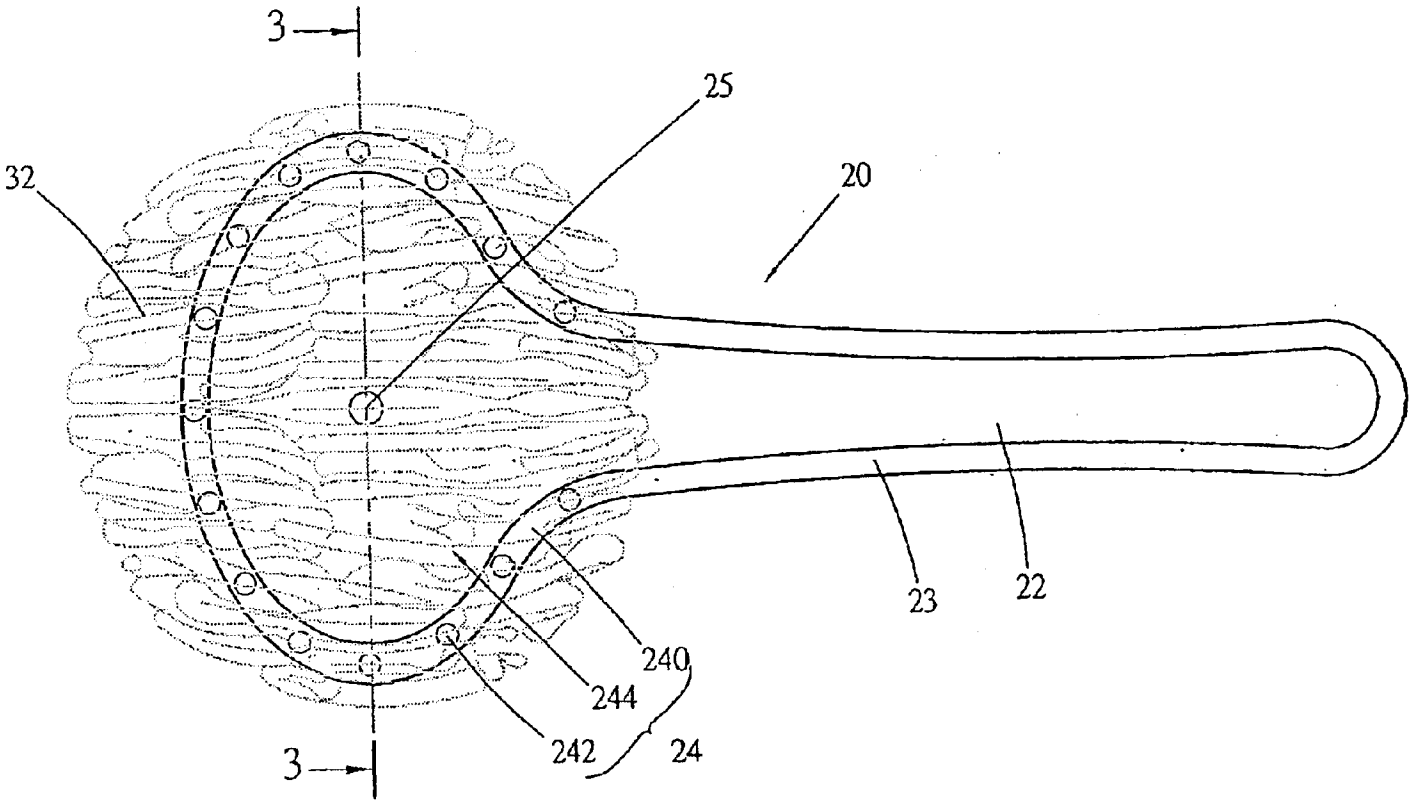
FIG. 1 is a top view of a first preferred embodiment of the present invention in an exploded condition.
Figure 2:
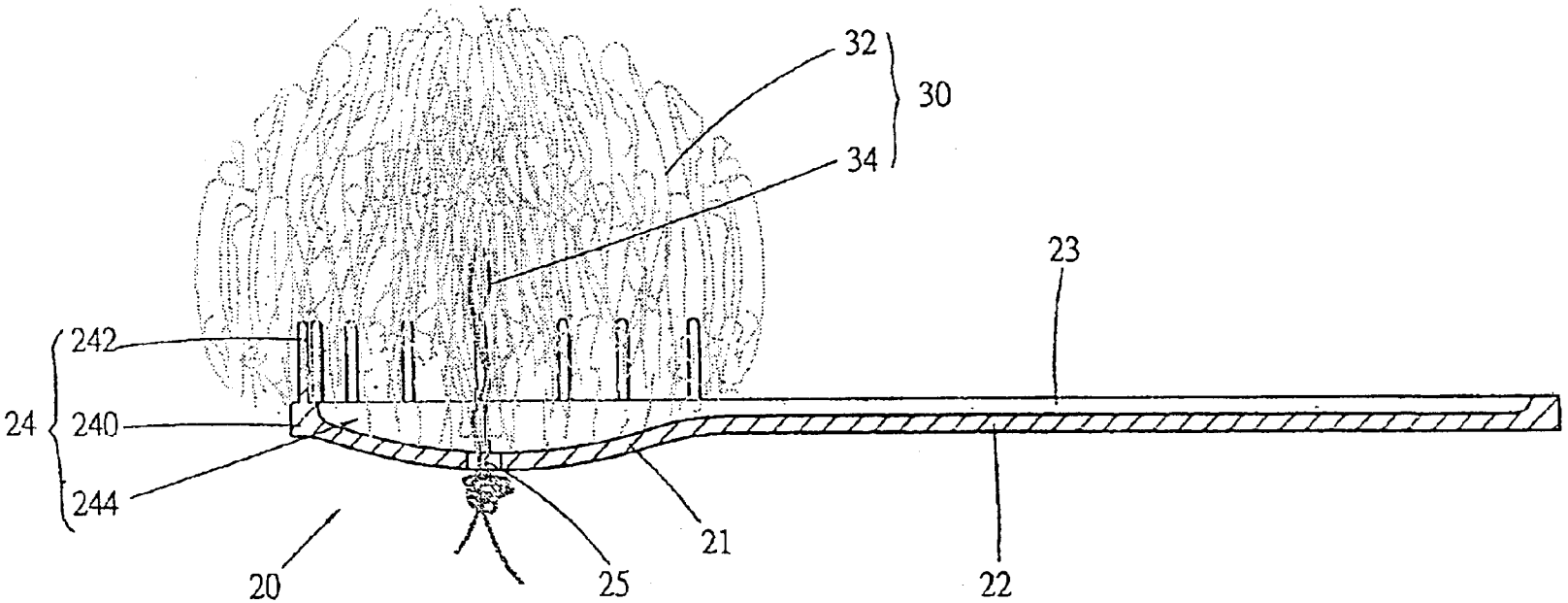
FIG. 2 is a front view of the first preferred embodiment of the present invention in an exploded condition.
Figure 3:
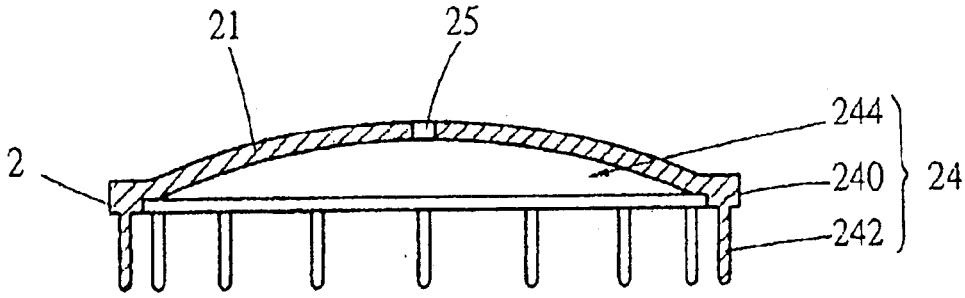
FIG. 3 is a sectional view along a 3—3 line in FIG. 1.

Please refer to FIGS. from FIG. 1 to FIG. 3, a bathing brush of the preferred embodiment of the present invention mainly comprises a bathing handle 20 and a conventional bathing ball 30 fastened thereon.

The bathing handle 20 is made from a single unit and has a suitable length on which has a bearing portion 21, a shank 22, an enhanced portion 23, a positioning portion 24 and a connection portion 25. The bearing portion 21 is substantially elliptical having a suitable area and a concave bottom side. The shank 22 is projected from a side of the bearing portion 21 having a suitable length for user to grip it. The enhanced portion 23 is around bathing handle 20 which is thicker in thickness to make the strength of the handle 10 enhanced. The positioning portion 24 has an annular flange 240 around the bearing portion 21 and plural of protrusions 242 projected from a top of the flange 240. The flange 240 enhances the strength of the bearing portion 21 and surrounds a space 244 therein on the concave bottom side of the bearing portion 21. The connection portion 25 is a through hole on the bearing portion 21 in the present preferred embodiment, in practice the connection portion 25 also can be a pair of through holes.

The bathing ball 30 has a waved flexible net 32 and a flexible fastening device 34 fastening the net 32 at a center portion thereof to make the net 32 expended as a ball. The fastening device 34 has a section left out of the ball-like net 32. The flexible net 32 can be replaced by a sponge (not shown).

In assembling, the left out section of the fastening device 34 runs through the through hole 25 of the bearing portion 21 to force the ball-like net 32 received in the space 244 and against the concave bottom side of the bearing portion 21 and the protrusions 242 are inserted into the bathing ball 30 and the section of the fastening device 34 running through the through hole 25 is tied a knot. The knot's size is bigger than the diameter of the through hole 25 such that the bathing ball 30 is fixedly fastened on the bathing handle 20.

It is very easy to fasten the bathing ball 30 on the bathing handle 20 such that user can replace the old or dirty bathing ball 30 with a new one by himself/herself. The present invention further has three advantages:

1. The space 25 on the bear portion 21 will restrict the bathing ball therein to prevent it from moving when brushing.

2. The space 25 also can temporally keep water therein such that the bathing ball can keep in wet for a longer time when brushing.

3. The protrusions 242 will hold the bathing ball more fixedly.

Figure 4:
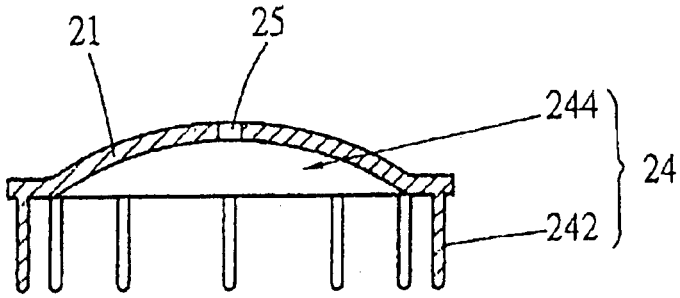
FIG. 4 is a sectional view of a second preferred embodiment of the present invention.
Figure 5:
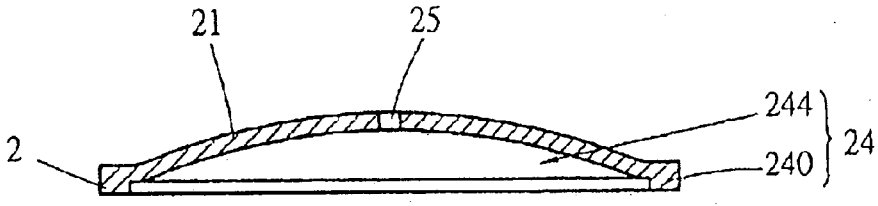
FIG. 5 is a sectional view of a third preferred embodiment of the present invention.

In the above structure, the flange 240 and the protrusions 242 are made to restrict the bathing ball 30 fixedly. FIG. 4 shows a second structure which has a bearing portion 21 having protrusions 242 around but no flange is provided. The area of the bearing portion is smaller than above. FIG.

5 shows a third structure which bearing portion 21 only has flange 240 with a higher height. These alternated structures will be within the scope of the present invention.

Figure 7:
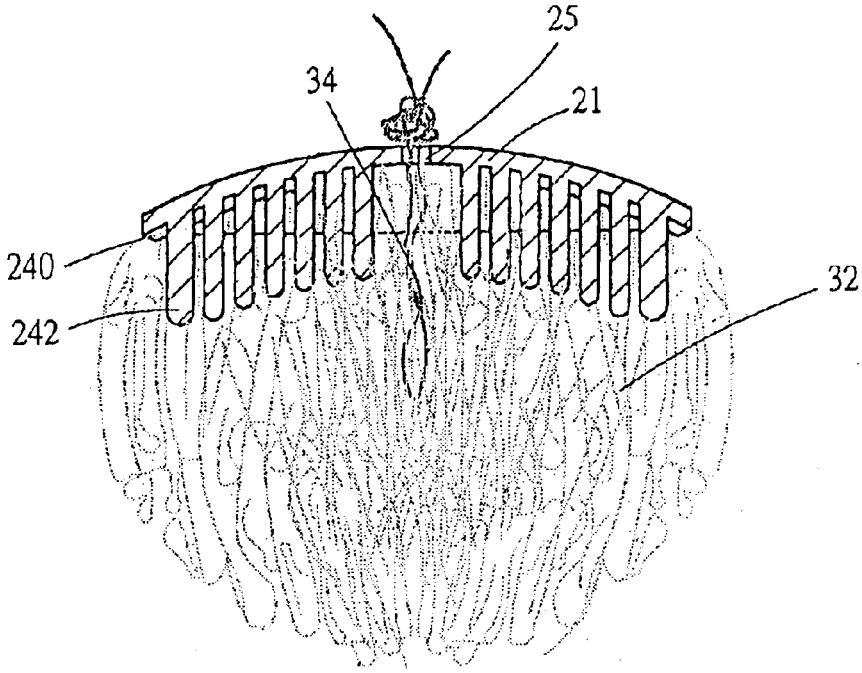
FIG. 7 is a sectional view of a fourth preferred embodiment of the present invention.
Figure 6:
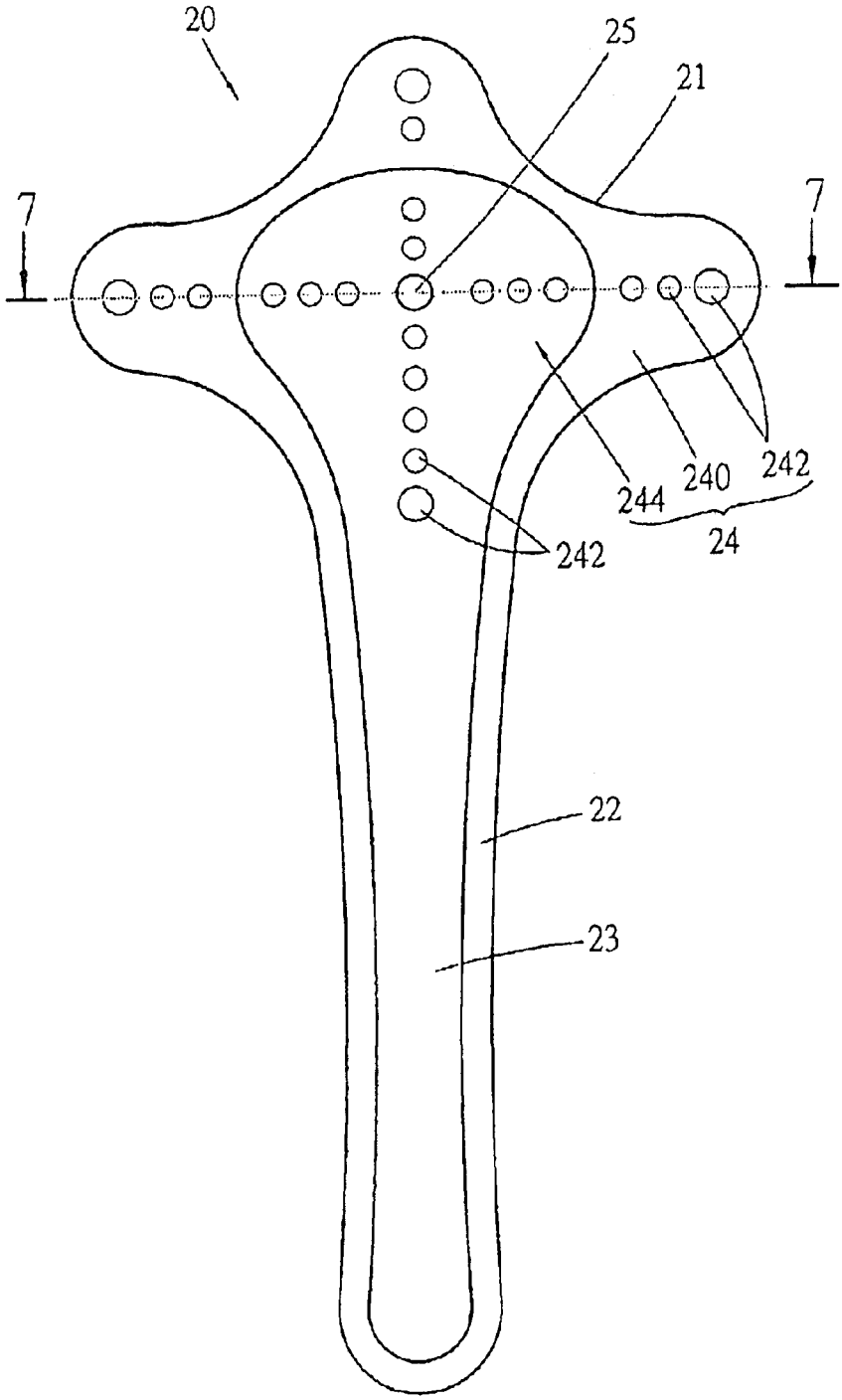
FIG. 6 is a top view of a fourth preferred embodiment of the present invention.
Figure 8:
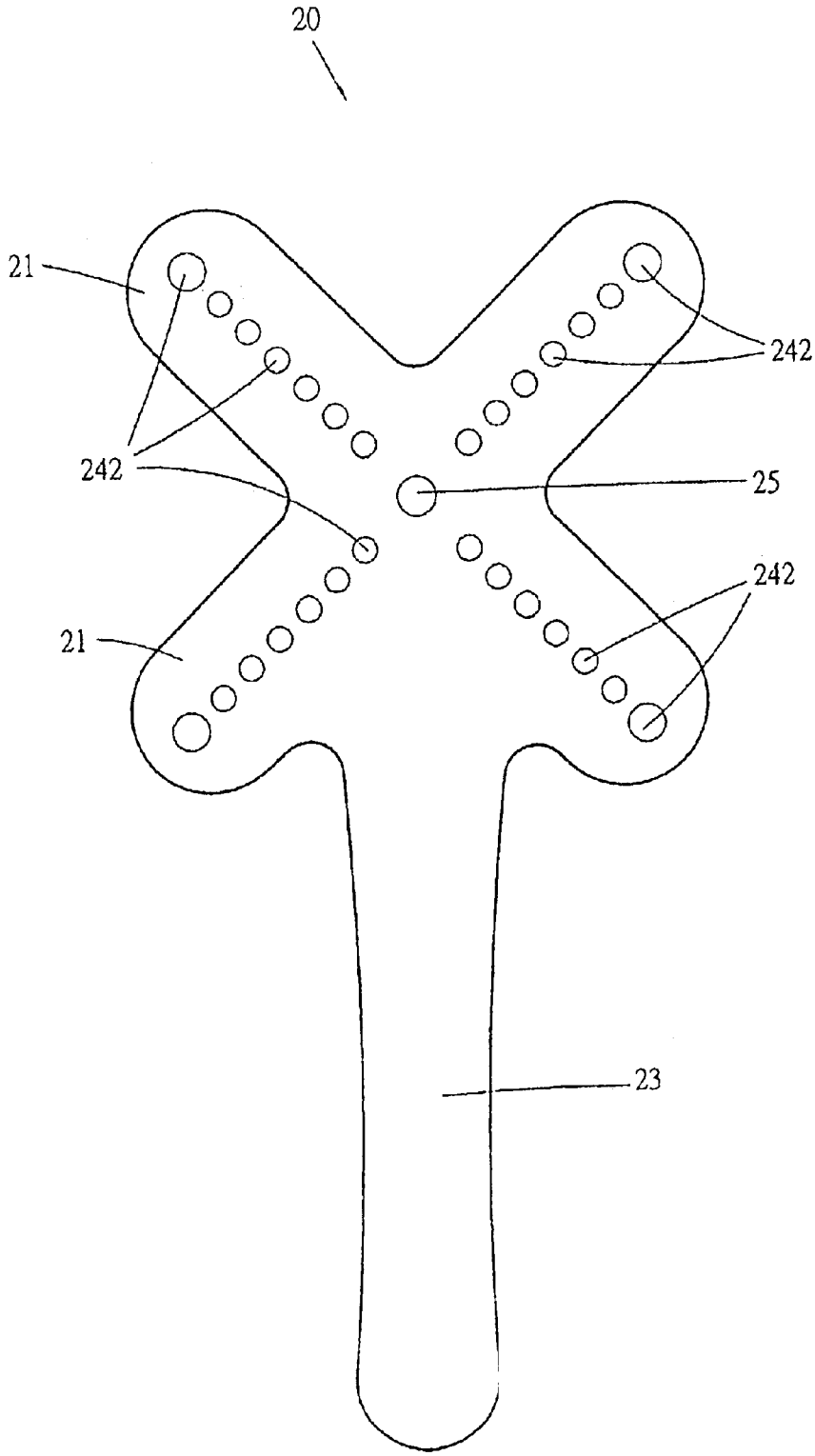
FIG. 8 is a top view of a fifth preferred embodiment of the present invention.

The arrangement of the protrusions 242 is annular as shown in FIG. 1, they also can be arranged in cross (FIG. 6 and FIG. 7) or in X (FIG. 8). Such arrangement of the protrusions 242 can independently hold the bathing ball fixedly without the space 244.

Figure 9:
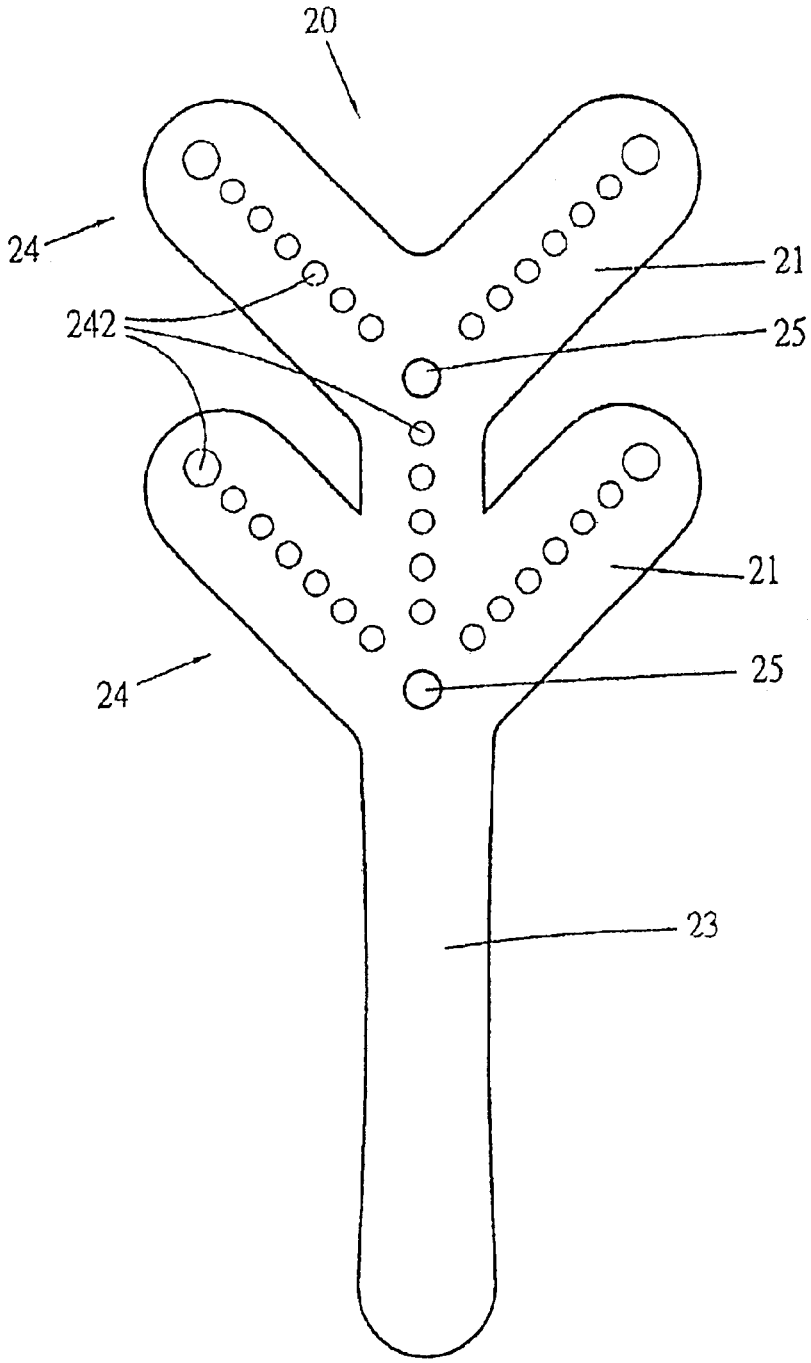
FIG. 9 is a top view of a sixth preferred embodiment of the present invention.

FIG. 9 shows two positioning portions 24 are provided on the bathing handle 20 to fasten two bathing balls 30 thereon and the protrusions 242 are arranged radially from the connection portions 25 respectively. The protrusions 242 of the positioning portions 24 are extended along three orientations respectively and some protrusions 242 are located between the connection portions 25 that will make the bathing balls 30 can be fastened on the bathing handle 20 closer to each other and the length of the bathing handle 20 can be shortened.

What is claimed is:

1. A bathing handle, which detachably fastens a bathing ball with a fastening device thereon to be a bathing brush, the bathing handle comprising:

a bearing portion having a predetermined length, width and height;

a connection portion provided on said bearing portion to fasten the bathing ball on said bearing portion and restrict the bathing ball from moving along a height orientation of said bearing portion;

a positioning portion having a plurality of protrusions arranged on said bearing portion in predetermined intervals to restrict the bathing ball from moving along a length orientation and a width orientation; and, wherein said bathing handle further comprises two of said bearing portions, two of said connection portions and two of said positioning portions to fasten two bathing balls thereon respectively and some of said protrusions are located between said connection portions.

2. The bathing handle as defined in claim 1, wherein said bearing portion has a concave bottom.

3. The bathing handle as defined in claim 2, wherein said protrusions are arranged parallel at where are adjacent to a edge of said bearing portion.

4. The bathing handle as defined in claim 2, wherein said bearing portion has an annular flange thereon and said protrusions are arranged on said flange.

5. The bathing handle as defined in claim 1, wherein said protrusions are arranged radially from said connection portion.

6. The bathing handle as defined in claim 1, wherein said connection portion has at least a through hole on said bearing portion.

7. The bathing handle as defined in claim 1, wherein said connection portion is provided at a center of said bearing portion.

8. The bathing as defined in claim 1, wherein the bathing ball has a flexible net with the fastening device fastening the net to make the net extended as a ball-like element and the fastening device has a section left out of the ball-like element and fastened with said connection portion of the bathing handle.

9. The bathing handle as defined in claim 1, wherein the bathing ball is made from a sponge with the fastening device fastening the sponge to said connection portion of the bathing handle.

10. A bathing handle, which detachably fastens a bathing ball with a fastening device thereon to be a bathing brush, the bathing handle comprising:

a bearing portion having a predetermined length, width and height;

a connection portion provided on said bearing portion to fasten the bathing ball on said bearing portion and restrict the bathing ball from moving along a height orientation of said bearing portion;

a positioning portion having an annular flange and a plurality of protrusions with a predetermined height on said bearing portion, wherein a space is formed within said flange and a bottom side of said bearing portion to receive a portion of the bathing ball therein such that the bathing ball is restricted from moving along a length orientation and a width orientation;

and, wherein said bathing handle further comprises two of said bearing portions, two of said connection portions and two of said positioning portions to fasten two bathing balls thereon respectively and some of said protrusions are located between said connection portions.

* * * * *